US007743974B2

(12) United States Patent
Johansson et al.

(10) Patent No.: US 7,743,974 B2
(45) Date of Patent: Jun. 29, 2010

(54) CONTAINER WALL OF PAPER AND PROCESS FOR PRODUCING SUCH A CONTAINER WALL

(75) Inventors: Tord Johansson, Gävle (SE); Nils-Åke Larsson, Gavle (SE)

(73) Assignee: Korsnas AB, Galvle (SE)

( * ) Notice: Subject to any disclaimer, the term of this patent is extended or adjusted under 35 U.S.C. 154(b) by 1127 days.

(21) Appl. No.: 10/450,445

(22) PCT Filed: Dec. 12, 2001

(86) PCT No.: PCT/SE01/02744

§ 371 (c)(1),
(2), (4) Date: Oct. 28, 2003

(87) PCT Pub. No.: WO02/49834

PCT Pub. Date: Jun. 27, 2002

(65) Prior Publication Data

US 2004/0056080 A1 Mar. 25, 2004

Related U.S. Application Data

(60) Provisional application No. 60/263,504, filed on Jan. 24, 2001.

(30) Foreign Application Priority Data

Dec. 19, 2000 (SE) ..... 0004705

(51) Int. Cl.
*B65D 3/04* (2006.01)

(52) U.S. Cl. ..... 229/400; 229/4.5

(58) Field of Classification Search ..... 220/669, 220/670, 671, 674, 703, 720; 229/4.5, 400, 229/406

See application file for complete search history.

(56) References Cited

U.S. PATENT DOCUMENTS 860,904 A * 7/1907 Chamberlain ..... 4/285
3,997,696 A * 12/1976 Jaisle et al. ..... 428/164

(Continued)

FOREIGN PATENT DOCUMENTS

EP 0068334 A1 5/1983

(Continued)

OTHER PUBLICATIONS www.paperonweb.com, Pulp and Paper Dictionary, Oct. 24, 2006, pp. 1 and 28.*

(Continued)

*Primary Examiner*—Stephen Castellano
(74) *Attorney, Agent, or Firm*—Bacon & Thomas, PLLC

(57) ABSTRACT

A container wall of paper (10, 22) for a container with a predominantly circular or elliptic cross-section is disclosed. The paper is a highly extensible Kraft paper, preferably with an extension of 5% to 20%. The container wall (10, 22) has at least one inwards or outwards (12, 14, 16, 26) from the periphery (20, 14, 32) extending portion. The containers produced with the container wall may be bottles, cans, jars, disposable, cups, drinking glasses, barrels, and vases. Further, a process of producing a container wall of paper (10, 22) is described. In the process highly extensible Kraft paper is pressed between a hard form providing the shape of the container wall (10, 22), and a matching hard counter form; a soft flexible counter form which under pressure follows the shape of the hard form, and liquid or gas that under pressure forces the paper to follow the shape of the hard form.

1 Claim, 2 Drawing Sheets

U.S. PATENT DOCUMENTS

| | | | | |
|---|---|---|---|---|
| 5,236,119 | A | 8/1993 | Chu | |
| 5,506,046 | A * | 4/1996 | Andersen et al. | 428/34.5 |
| 6,126,584 | A * | 10/2000 | Zadravetz | 493/109 |
| 6,264,053 | B1 * | 7/2001 | Slat | 215/384 |

FOREIGN PATENT DOCUMENTS

| | | |
|---|---|---|
| EP | 1031514 A1 | 8/2000 |
| JP | A-52-92673 | 8/1977 |
| JP | Y-57074112 | 5/1982 |

OTHER PUBLICATIONS

Japanese Examined Patent Publication No. 55-051781, "Food container and method for producing the same", English translation.

Japanese Laid-open Patent Publication No. 58-099391, "Method for filling and hermetically sealing container at high temperature", English translation.

Japanese Laid-open Patent Publication No. H10-94848, "Method for forming concave-convex pattern on side wall of seamless can", English translation.

Japanese Laid-open Patent Publication No. H10-008394, "Press-molding paper and method for producing molded products by carrying out press-molding", English translation.

Japanese Examined Patent Utility Model Publication No. S37-030596, "Elongatable composite web", English translation.

* cited by examiner

CONTAINER WALL OF PAPER AND PROCESS FOR PRODUCING SUCH A CONTAINER WALL

This application is the national phase of international application number PCT/SE01/02744 and claims priority under 35 U.S.C. 119(e) of U.S. application 60/263,504 of Jan. 24, 2001.

The present invention relates to a container wall of paper and to a process for the production thereof. The container wall is formed without folding. The container wall is to be used primarily in the manufacture of bottles, cans, jars, disposable cups, drinking glasses, barrels, and vases.

BACKGROUND OF THE INVENTION

Paper containers of today are either folded to form bottom and sidewalls from the same sheet of paper, or folded to form box-like structures, or are formed to have an even cylindrical or conical sidewall and a round plane bottom of paper, metal sheet plate or some plastics. These prior art paper containers are impregnated or coated with different materials to render stiffness to the sidewalls and to form a barrier against liquid contents.

It has now surprisingly been found that it is possible to produce container walls of paper that are comparably rigid without folding.

DESCRIPTION OF THE INVENTION

The present invention makes it possible to produce containers for liquid, powdered and solid contents with a sidewall of paper and with unusual different appearances without folding the paper. Compacting zones may be built-in to facilitate disposal and gripping-facilitating forms may be designed.

The present invention is in one aspect directed to a container wall of paper (10,22) for a container with a predominantly circular or elliptic cross-section, which paper is a highly extensible Kraft paper and which wall (10,22) has at least one outwards from the periphery (14,32) extending portion (12,16,26, 28).

The container wall is made of one piece or two or several pieces forming portions of the final container wall.

The term "predominantly" is used in the description and claims in conjunction with circular or elliptic cross-section to reflect to fact that the body of the container has circular or elliptic cross-section whereas the bottom and/or the top outward from the periphery extending portions (16, 18) of the container wall (10,22) may be tapered to form e.g. a bottle neck or a barrel-like structure.

The container wall is to be used preferably for containers having a volume of up to one liter. The container is preferably selected from the group consisting of bottles, cans, jars, disposable cups, drinking glasses, barrels, and vases.

The bottom and/or top of such a container may be of any suitable material such as metal, plastics or paper. For example, the bottom and/or top of such a container may be produced by the same technique as the container wall of the present invention.

The highly extensible Kraft paper used in the container wall of the invention has an extension of 5% to 20%, preferably 10% to 15%, and at present most preferably 15%.

The Kraft paper may be selected from unbleached and bleached, uncoated and coated, one or two or multi ply Kraft paper qualities. Two or more separate sheets of paper may also be used to form the container wall of the invention. The surface of the paper has preferably a good printability. The coating may be a barrier layer or polymer coating of e.g. polyolefin, preferably polyethylene. The paper may also be impregnated and surface treated with chemicals to resist moisture. The coating may be applied on either or both sides of the paper.

The container wall of the invention has at least one outwards from the periphery extending portion or section. This renders rigidity to the construction.

In one embodiment the outwards from the periphery extending portion (26) has a convex silhouette.

In another embodiment the container wall has several outwards from the periphery extending portions (12, 16, 26, 28).

In still another embodiment the outwards from the periphery extending portion(s) (26, 28) is (are) in the length direction of the container.

In a further embodiment of the container wall of the invention the outwards from the periphery extending portion(s) (12, 16) is (are) in the breadth direction of the container.

Production of the container wall of the invention may be accomplished by a process of producing a container wall of paper (10,22) with a predominantly circular or elliptic cross-section, which comprises the steps of obtaining a highly extensible Kraft paper, pressing the paper between a hard form providing the shape of the container wall (10,22), or a portion of the container wall, which has at least one outwards from the periphery extending portion (12, 16, 26, 28), and a member from the group consisting of a matching hard counter form, a soft flexible counter form which under pressure follows the shape of the hard form, and liquid or gas that under pressure forces the paper to follow the shape of the hard form, simultaneously with or subsequent to the pressing operation sealing overlapping paper sides of the container wall, or sides of the parts of the container wall, to produce the final container wall.

The pressing against the hard form providing the shape of the container wall may be performed by a matching hard counter form which should follow the shape of the hard form leaving an even room between the forms adapted to the thickness of the paper to be treated, or a soft flexible counter form, preferably a cylinder, e.g. made of a polymer or rubber, which under pressure follows the shape of the hard form, or liquid, e.g. impregnating liquid or the liquid to be filled in the final container, such as water, milk or juice, or gas, e.g. air or nitrogen, that under pressure forces the paper to follow the shape of the hard form.

The process of producing the container wall of the invention is preferably used in the manufacture containers which are selected from the group consisting of bottles, cans, jars, disposable cups, drinking glasses, barrels, and vases.

The raw material for the process is preferably a highly extensible Kraft paper which has an extension of 5% to 20%, more preferably 10% to 15%, and at present most preferably 15%.

The pressure imposed on the paper is preferably in the range of 9.8 MPa to 29.4 MPa (100 to 300 kg/cm$^2$).

The temperature in the pressing operation is preferably in the range of from room temperature to 350° C. The container wall will be more rigid when the pressing is conducted at a higher temperature than ambient temperature. At temperatures of approximately 300° C. the surface of the paper will get a much higher gloss than the untreated paper.

The raw material for the process is Kraft paper that may be selected from unbleached and bleached, uncoated and coated, one or two or multi ply Kraft paper qualities. Two or more separate sheets of paper may also be used to form the container wall of the invention. The surface of the paper may preferably give a good printability. The coating may be a barrier layer or polymer coating of e.g. polyolefin, preferably polyethylene. The coating may be applied on either or both sides of the paper.

DESCRIPTION OF A PROTOTYPE EMBODIMENT

Figure 1:
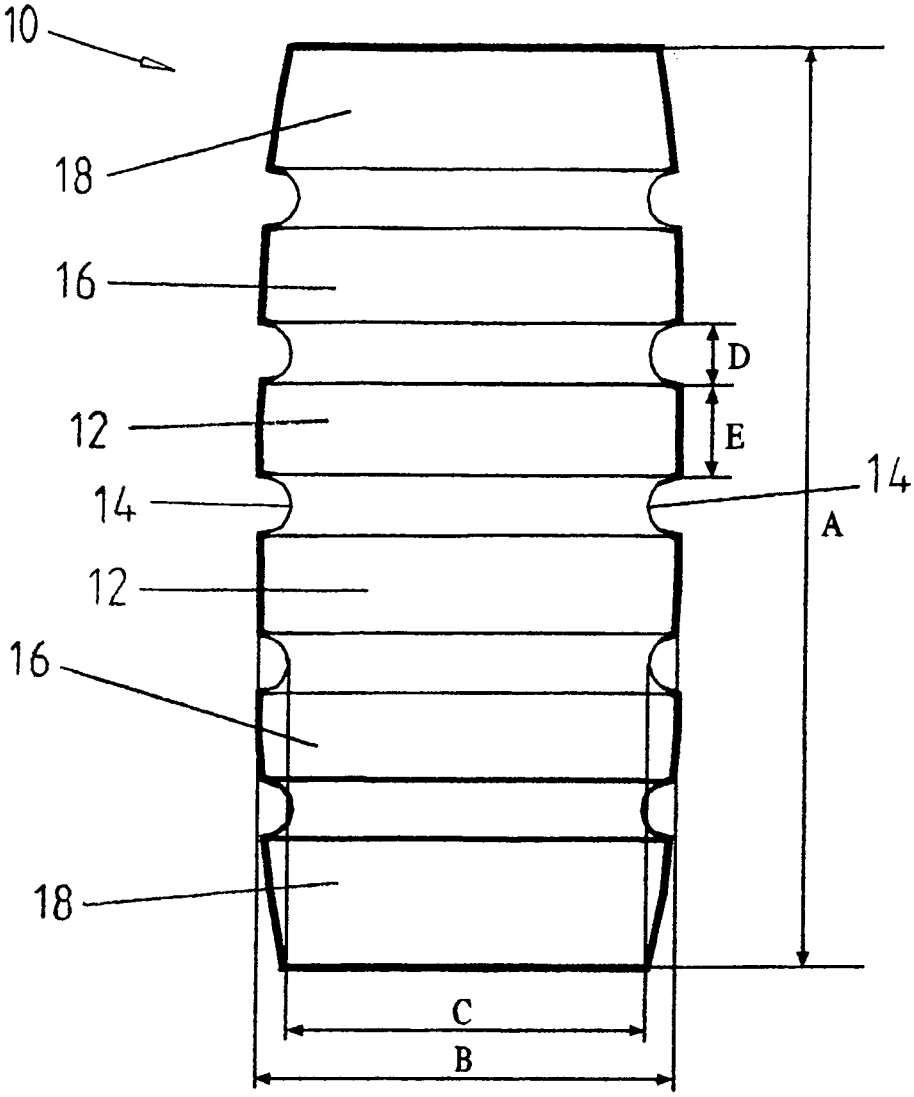
FIG. 1 is a side view of a container wall 10 produced in a prototype process of the invention. The container wall 10 has an overall shape of a barrel. The middle outwards extended portions 12 have the largest diameter. The sections between the outwards extended portions 14 form a half-circle. The junction between the half-circles outward extending portions 14 and the outwards extending portions 12, 16 and 18 are somewhat rounded but this is not shown on the figure. The next to first and last outwards extending portions 16 are somewhat tapered in relation to the outwards extending portions 12, and the first and last outwards extending portions 18 are even more tapered. The height A of the container wall 10 is 150 mm, the largest diameter of the middle outward extending portion 12 of the container wall B is 71 mm, the diameter of the bottom and top openings 20 designated C is 62 mm, the breadth of the outwards extending portions 12 designated D is 10 mm and the diameter of the half-circles outwards extending portions 14 between the outwards extending portions 12 designated E is 15 mm.
Figure 2:
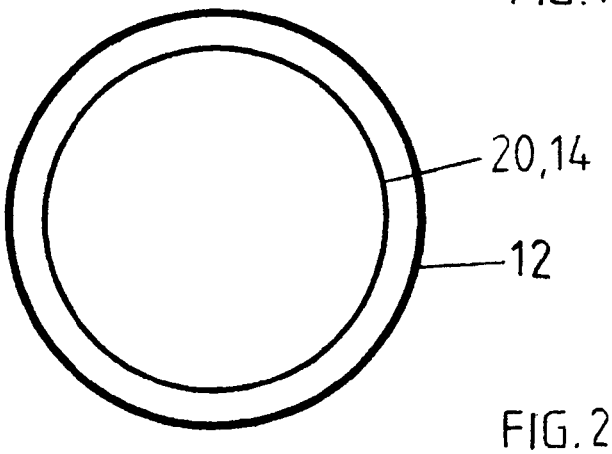
FIG. 2 is a cross-section view of the container wall 10 wherein 12 shows the middle outwards extending portions, 20 shows the circular bottom or top opening which coincides with the periphery of the connecting half-circular outward extending portions 14.
Figure 3:
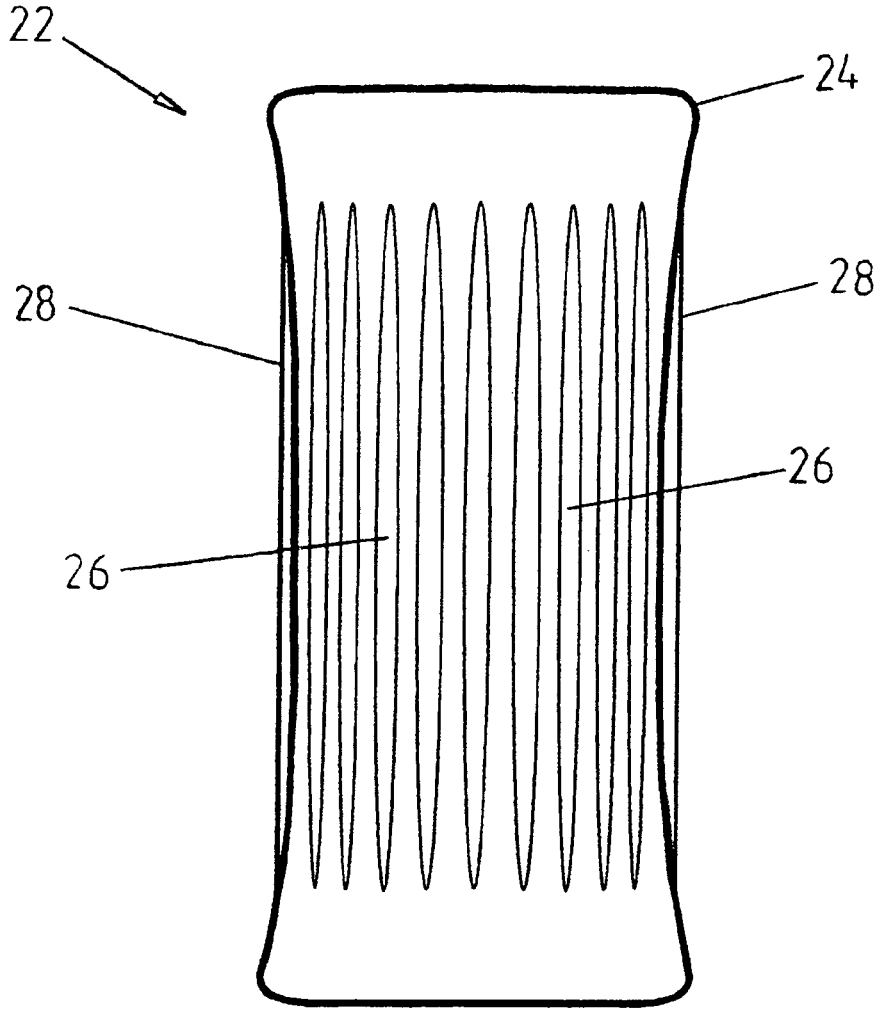
FIG. 3 is a side view of an embodiment of a container wall 22 according to the invention. The overall shape of the container wall 22 is a slightly hour-glass or waist form. The top and bottom edge parts 24 of the predominantly circular container wall are extended and rounded. The outwards extending portions are designated 26, and the most extended parts of the outward extending portions 26 are designated 28.
Figure 4:
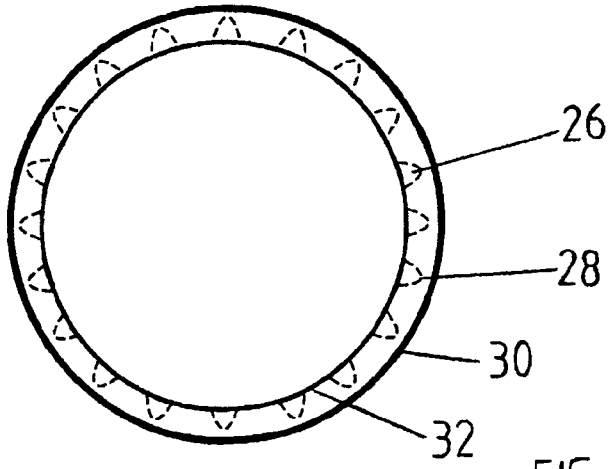
FIG. 4 is a cross-section view of the container wall 22 wherein 26 are the outwards extending portions, 28 are the most extended parts of the outwards extending portions 26, is the circular outer part of the top and bottom edge parts 24 defining the openings of the container wall 22, and 32 is the circular periphery of the top and bottom edge parts 24 defining the openings of the container wall 22.

A thick metal piece was cut and grooved to the designed form of the container wall (10). The metal piece was in three matching parts that were put together and secured, with a suitably sized paper sheet cylinder with overlapping paper sides on the inside. A rubber cylinder with a diameter just smaller than the smallest diameter of the metal form was placed inside the form from the open bottom. Pressurized air was applied inside the rubber cylinder from a nozzle connected to a container containing pressurized air.

The form had a size providing a container wall for a container of half a liter size with an overall barrel shape. The form had several outwards from the periphery extending portions or sections.

Bleached Kraft paper of 150 g/m$^2$ grammage and an extension of 15% (Korsnäs ABC paper) was used as the raw material in the production of a container wall in one piece with overlapping sides. A pressure of 19.6 MPa (200 kg/cm$^2$) was applied inside the rubber cylinder whereby the rubber was expanded and forced the paper to stretch and follow the contour of the form. The temperature was room temperature.

The paper was removed from the form and the overlapping sides were sealed with an adhesive to form the final container wall.

The same procedure was repeated with a bleached Kraft paper of 150 g/m$^2$ grammage having a 30 g/m$^2$ polyethylene coating on one side. The sides were sealed with an adhesive, but may be sealed with application of heat.

The above disclosed procedure was repeated with two bleached Kraft papers of 150 g/m$^2$ grammage each having a 30 g/m$^2$ polyethylene coating on one side. The two papers were put together with the sides having the polyethylene coatings against each other. The side edges of the two papers were arranged so that they were overlapping and no edges were ending at the same vertical place. The form was heated to 80-100° C. before the pressure was applied. The polyethylene melted and the container wall was very rigid after cooling. No separate sealing of the sides was necessary. Due to the flexibility of the paper, the side edges sank into the joint material to such an extent that no side edges of the final container wall could be felt by the hand.

The invention claimed is:

1. A non-folded paper container wall of a container with a predominantly circular or elliptic cross-section, which paper is a highly extensible Kraft paper that has an extension of 10% to 15% and which wall has at least one outwards from the periphery extending stretched portion.

* * * * *